United States Patent [19]

Rones

[11] Patent Number: 4,910,826

[45] Date of Patent: Mar. 27, 1990

[54] SURFACE WORKING PAD ASSEMBLY

[75] Inventor: James M. Rones, Atlanta, Ga.

[73] Assignee: Americo, Acworth, Ga.

[21] Appl. No.: 250,875

[22] Filed: Sep. 29, 1988

[51] Int. Cl.[4] ..... B24B 29/00

[52] U.S. Cl. ..... 15/230; 15/98; 15/257 R

[58] Field of Search ..... 15/230.19, 230.16, 230.17, 15/230.18, 230, 98, 257 R

[56] References Cited

U.S. PATENT DOCUMENTS

| | | | |
|---|---|---|---|
| 3,346,904 | 10/1967 | Armstrong | 15/230.17 X |
| 3,462,889 | 8/1969 | Erickson | 15/230.17 X |
| 3,522,681 | 8/1970 | Lampert | 15/230.17 X |
| 3,527,001 | 9/1970 | Kleemeier et al. | 15/230.17 X |
| 3,703,739 | 11/1972 | Young et al. | 15/230.17 |
| 4,114,225 | 9/1978 | Malish et al. | 15/230.17 |
| 4,293,973 | 10/1981 | Schar | 15/230.17 |
| 4,407,040 | 10/1983 | Scharf | 15/230.17 |
| 4,491,999 | 1/1985 | Babcock | 15/230 |

*Primary Examiner*—Chris K. Moore

*Attorney, Agent, or Firm*—Sughrue, Mion, Zinn, Macpeak & Seas

[57] ABSTRACT

A novel surface working pad assembly is described which assembly comprises a fibrous generally disc shaped pad support element having a circular raised portion at its center; the raised portion is sized and configured to fit closely within a circular aperture of a cooperating surface working pad element, but preferably remains recessed and out of contact with the work surface during use thus reducing drag and wear. The surface working pad element of the assembly is removably attached to the pad support element so that by reversing the working pad both surface may be used. The mating of the raised portion of the pad support element into the aperture of the working pad enables the working pad to be quickly; and accurately mounted on a machine and prevents unwanted displacement of the pad due to centrifugal forces, even during use in high speed rotary floor polishers or the like.

10 Claims, 1 Drawing Sheet

SURFACE WORKING PAD ASSEMBLY

BACKGROUND OF THE INVENTION

1. Field of the Invention

This invention relates to a working pad assembly for use in surface maintenance machines such as the familiar power driven, rotary floor maintenance machines which are used to strip wax, apply wax, buff, polish, etc.

2. Background of the Invention

Many different types of working pads and assemblies therefor have been used over the years. The present standard is an approximately 1" thick pad of non-woven plastic fibers of polyester, nylon, etc. Various means have also been adopted for releasably or removably attaching the pads to the drive disc of the machines, including clamps, snap rings, etc. "Velcro" (fibrous hook-and-loop connectors) is also now widely used for this purpose.

According to my invention a working pad assembly is provided that greatly saves on material and cost, provides for "Velcro"-type ease of mounting, and retains the feel and performance of the standard 1" pad, by providing the cushioning and pliability for the working pad to scrub, clean, and polish uneven floors which contain dips, ridges, and other irregularities, even when employed in high speed rotary machines. Since standard 1" working pads absorb old wax and dirt generally about ¼" into the working surface, the center ¾" of the working pad is unused while my invention, preferably using an approximately ¾" thick resilient pad support element and an approximately ¾" surface working pad, provides the necessary cushioning and allows old wax and dirt to penetrate approximately ¼" into each side of the ¾" thick working surface pad.

DESCRIPTION OF PRIOR ART

The most relevant prior art of which applicant is aware is believed to be U.S. Pat. No. 3,703,739 Young et al which discloses multiple layer surface working pads stacked and affixed each to the other and to the drive disc of a rotary polisher by "Velcro"-type connectors.

In this system the operator essentially carries a pad inventory stacked up under the polisher. While applicant has not tested the Young et al system, it seems to present serious problems, such as centrifugal dislocation or separation, especially as the number of stacked pads is increased, alteration of the normal working height of the machine, and probable increase in drag by having full surface contact of pad surface and work surface. In ultra high speed polishers in use today, which operate at 2,000 RPM and higher, the stack approach of Young seems to be of especially doubtful feasibility.

By contrast, however, it will be seen that the present invention permits pad reversal while at the same time providing substantially the same shape and performance of the standard integral pad.

Other patents in this field of which I am aware are listed below, but I believe they are even less relevant than the above discussed patent of Young et al:

| | | | |
|---|---|---|---|
| 3,115,660 | Hunt | 3,823,516 | Christian |
| 3,346,904 | Armstrong | 4,407,040 | Scharf |
| 3,522,681 | Lampert | 4,541,207 | Antonson |
| 3,527,001 | Kleemeier et al | 4,747,176 | Parks |

SUMMARY OF THE INVENTION

The present invention relates to a surface working pad assembly for use in surface maintenance equipment, especially, power driven rotary disc floor polishers or the like.

The assembly comprises two basic elements, namely, a pad support element and a surface working pad element. Each is preferably formed of the same material, e.g., non-woven plastic fibers, such as nylon, polyester, etc.

The pad support element is disc shaped and means are provided to removably attach its upper flat surface to the drive disc of the equipment on which the assembly is used. The lower face of the pad support element has a raised portion shaped to be received in a similarly shaped aperture in the surface working pad element.

The apertured surface working pad element has two working surfaces, so that after one surface is clogged or glazed over, the pad can be reversed to use the fresh surface of the pad.

While not critical it is most convenient that the aperture in the surface working pad and the raised portion of the pad support element be configured to be approximately equi-diameter circles, so that they will engage snugly when pressed in face-to-face contact.

The height of the raised portion of the pad support element should be such that it remains recessed when fully inserted into the aperture of the surface working pad element, so as to reduce drag on the machine, and prevent the pad support element from being worn.

Any convenient means may be employed to removably mount the surface working pad on the pad support; the most satisfactory means so far contemplated by me is to employ a series of strips or tapes of fibrous hooks ("Velcro"-type material) on the underside of the pad support element which can engage the loops present in the non-woven plastic fiber working pad element.

In commercial use it is contemplated that a pad support element and a quantity of surface working pads would be sold as a kit. The assembly is immediately useful on all machines which are adapted to receive a standard 1" surface working pad which is bonded to the drive disc by "Velcro"-type connectors, or stiff bristles, or the like. The thickness of the pad support and surface working pad elements would preferably be such as to give a thickness about equal to the thickness of the standard 1" pad thus mimicking for the operator the feel and performance of the standard integral pad while providing two useable working surfaces in a surface working pad about one half the thickness.

DETAILED DESCRIPTION OF PREFERRED EMBODIMENTS OF THE INVENTION

Figure 1:
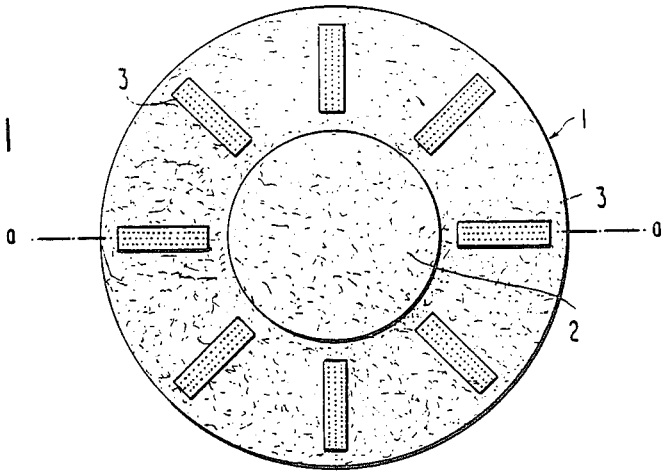
FIG. 1 is a plan view of the under surface of the pad support element.

Referring to the drawings, FIG. 1 shows a plan view the under surface of the pad support element 1 of the invention. In practice, this pad support element 1 is a circular, generally disc-shaped body of non-woven plastic fibers which can be formed from the same material as the surface working pad element, thereby providing comparable resiliency and "feel." Surface working pads are available in various diameters, usually from about 17" to 22". A popular, widely useful size would be 20" in diameter and about ¼" in thickness. A raised portion 2 preferably of the same material, and preferably, but not necessarily, of a generally circular configuration is centered on the under side (surface facing side) of element 1. For an element having a diameter of 20", the raised portion will generally be about 8"–10" in diameter and its thickness or height will be less than the thickness of the surface working pad element 6. The raised portion 2 may be formed integrally with pad support element 1, or it may be formed separately and bonded onto element 1, adhesively or otherwise.

In the preferred embodiment, a plurality of radially extending "Velcro"-type strips 3 containing fibrous hooks for engaging the surface working pad element are provided as the means for removably connecting pad support element 1 to surface working pad element 6. These strips or tapes 3 may be fusion bonded, glued, stapled or otherwise attached to the lower surface of pad support element 1.

Figure 2:
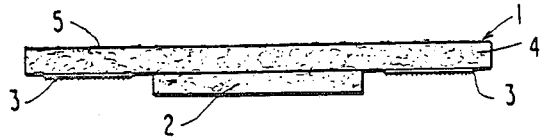
FIG. 2 is a cross-sectional view of the pad support element along line a—a of FIG. 1.

FIG. 2 shows the pad support element 1 in cross-section taken along line a—a of FIG. 1 with the raised portion 2 facing downwardly, i.e., toward the work surface. In this view the main body 4 of the element is seen to be disc-shaped and to have an upper flat surface 5 which is composed of an open mass of bonded, non-woven fibers capable of being engaged by attachment means of "Velcro"-type fibrous hooks carried on the face of a rotary drive disc 12 of a surface treating apparatus. (See FIG. 5).

Figure 3:
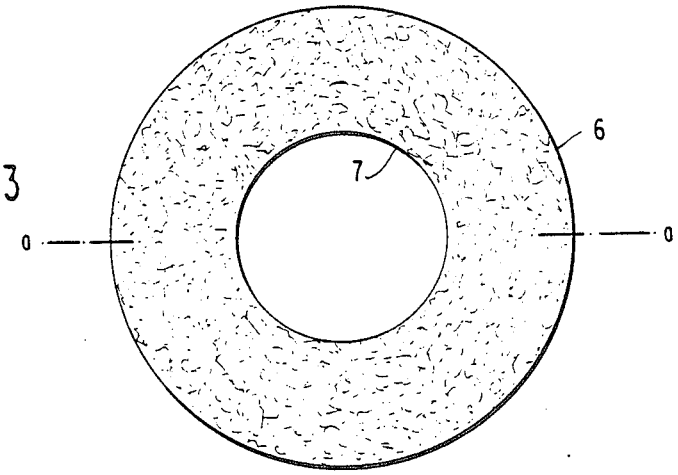
FIG. 3 is a plan view of the surface working pad element.

FIG. 3 illustrates, in plan view, a surface working pad element 6 with a centered aperture 7, preferably of circular configuration roughly corresponding in shape and size to the raised portion 2 of element 1 of FIG. 2. Raised portion 2 of element 1 should preferably make a snug fit in aperture 7 of element 6.

Figure 4:
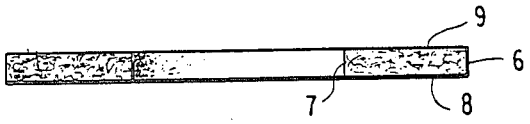
FIG. 4 is a cross sectional view of the surface working pad element along line a—a of FIG. 3.

FIG. 4 illustrates surface working pad 6 in cross-section, along line a—a of FIG. 3, showing aperture 7 and two working surfaces 8 and 9. Surfaces 8 and 9 are removably attachable to element 1 via any suitable means, but preferably by use of the "Velcro"-type strips 3 shown in FIGS. 1 and 2 on the lower surface of element 1. Surfaces 8 and 9 are of open, non-woven, fibrous material, the structure of which enables such surfaces to be engaged readily by the fibrous hooks of strips 3.

Figure 5:
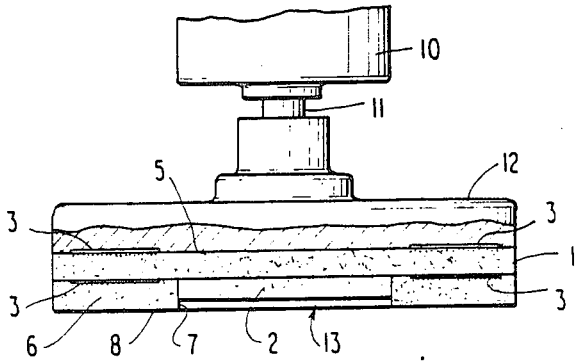
FIG. 5 is a cross-sectional view of the surface working pad assembly mounted on the drive disc of a surface working machine.

FIG. 5 is a cross-sectional view of the complete assembly of the invention mounted on the rotary drive disc 12 of a surface working apparatus. As will be seen the drive disc 12 is connected to a drive shaft 11 which is driven directly or indirectly by motor 10. The upper surface of element 1 is removably bonded preferably by "Velcro"-type material 3 on the face of drive disc 12. Element 1 has mounted on it surface working element 6. Raised portion 2 of element 1 is snugly engaged in aperture 7 of element 6, and is preferably recessed 13. When exposed surface 8 is used up, surface working pad element 6 may be detached, reversed, and replaced to expose surface 9 for use.

What is claimed is:

1. A surface working pad assembly for use in a surface maintenance apparatus which comprises a rotatable member to which said assembly may be removably attached during machine operation, and means to drive said rotatable member with said pad assembly mounted thereon, said surface working pad assembly comprising (a) a pad support element comprising a circular disc shaped element having a flat surface on one side for attachment to said rotatable member, and, on its other side, a flat, non-raised peripheral portion, and a centrally located, raised portion, facing toward the surface to be worked, (b) a surface working pad element of circular disc shaped configuration with two flat surface working surfaces, said surface working pad element having a diameter substantially corresponding to the diameter of said support pad element, and having a centrally located, aperture which is sized to receive in relatively closely fitting relationship said raised portion of said pad support element, when said surface working pad element is placed in face to face relationship with said pad support element, (c) means to removably attach either working surface of said surface working pad element to said pad support element, so that each working surface thereof may in turn be exposed for surface working during operation of said apparatus, and (d) means to removably attach said flat surface of said pad support element to said rotatable member of said apparatus.

2. The device of claim 1 wheren the thickness of said surface working pad element is greater than the height of the raised portion of said pad support element, so that the surface of said raised portion of said pad support element remains recessed within the aperture in said surface working pad element when said pad support element and said surface working pad element are assembled in a face-to-face, mated relationship.

3. The device of claims 1 or 2 wherein said means to removably attach said pad support element to said rotatable member comprises attachment means mounted on the surface of said rotatable member which attachment means are capable of engaging said flat surface of said pad support element.

4. The device of claim 3 wherein said flat surface of said pad support element comprises a body of porous, non-woven fibrous material engageable by said attachment means.

5. The device of claim 4 wherein said attachment means comprises a plurality of elements projecting outwardly from the surface of said rotatable member, said elements being capable of engaging said pad support element when said flat surface of said pad support element is pressed against the surface of said rotatable member.

6. The device of claim 5 wherein said attachment means for attaching said pad support element to said rotatable member comprises Velcro-type connector means.

7. The device of claim 6 wherein said means to removably attach either working surface of said surface working pad element to said pad support element comprises a plurality of elements projecting outwardly from the surface of said pad support element, said elements being capable of engaging said surface working pad element when either flat surface of said surface working pad element is pressed against the surface of said pad support element.

8. The device of claims 1 or 2 wherein said surface working pad element comprises a body of porous, non-woven fibrous material.

9. The device of claim 8 wherein said surface working pad element is attached to said pad support element by Velcro-type connector means.

10. The device of claims 1 or 2 or wherein said surface working pad element comprises a body of porous, non-woven fibrous material, and said surface working pad element is removably connected to said pad support element by means of a series of strips of Velcro-type connectors mounted on the surface of said pad support element.

* * * * *

UNITED STATES PATENT AND TRADEMARK OFFICE

CERTIFICATE OF CORRECTION

PATENT NO. : 4,910,826

DATED : March 27, 1990

INVENTOR(S) : James M. Rones

It is certified that error appears in the above-identified patent and that said Letters Patent is hereby corrected as shown below:

Column 1, lines 30, 32, 33 and 36, delete "3/4", and insert --1/2--.

Column 3, line 13, delete "1/4", and insert --1/2--.

Signed and Sealed this

Thirtieth Day of June, 1992

*Attest:*

DOUGLAS B. COMER

*Attesting Officer*

*Acting Commissioner of Patents and Trademarks*